US006585497B2

(12) United States Patent
Hsieh

(10) Patent No.: US 6,585,497 B2
(45) Date of Patent: Jul. 1, 2003

(54) COOLING FAN DUST SEAL

(75) Inventor: Hsin Mao Hsieh, Taipei (TW)

(73) Assignee: Adda Corporation, Ping-Tung (TW)

( * ) Notice: Subject to any disclaimer, the term of this patent is extended or adjusted under 35 U.S.C. 154(b) by 0 days.

(21) Appl. No.: 09/970,700

(22) Filed: Oct. 5, 2001

(65) Prior Publication Data

US 2003/0068237 A1 Apr. 10, 2003

(51) Int. Cl.[7] ..... F04B 17/00; F04B 9/00

(52) U.S. Cl. ..... 417/423.1; 417/423.9; 417/423.12; 417/230

(58) Field of Search ..... 417/423.1, 423.9, 417/423.12; 415/230; 361/695

(56) References Cited

U.S. PATENT DOCUMENTS 3,580,588 A * 5/1971 Allen et al. ..... 277/420
5,090,868 A * 2/1992 Mosure et al. ..... 415/207
5,372,477 A * 12/1994 Cole ..... 415/218.1
5,586,871 A * 12/1996 Barnes et al. ..... 417/423.11
5,947,704 A * 9/1999 Hsieh ..... 417/423.12
6,183,221 B1 * 2/2001 Hsieh ..... 417/423.12

FOREIGN PATENT DOCUMENTS

JP 08-182242 * 7/1996 ..... H02K/5/10

* cited by examiner

*Primary Examiner*—Charles G. Freay
*Assistant Examiner*—Timothy P. Solak
(74) *Attorney, Agent, or Firm*—Leong C. Lei

(57) ABSTRACT

A cooling fan dust guard has provided on the inner side of fan blades ribs and recess that mutually form an overcut height difference with a bushing opening so to prevent the airflow carrying dust an easy ingression and even keep off the flying dust from entering into the spindle.

4 Claims, 4 Drawing Sheets

COOLING FAN DUST SEAL

BACKGROUND OF THE INVENTION (a) Field of the Invention

The present invention is related to a cooling fan dust guard, and more particularly, to one that prevents the airflow carrying dust an easy ingression and even keeps off the flying dust from entering into the spindle.

(b) Description of the Prior Art

A cooling fan is usually adapted to a motor. Though providing simple function, the cooling fan plays a very important role in cooling for the entire system. Upon starting the machine, the cooling fan is required to maintain long term operation. Since the cooling fan is essentially working on the spindle and the bearing that are two relatively mobile parts in the system, extra care is required for the interface between said two parts, which must be kept properly lubricated and without ingression of foreign matters to warrant longer service life for the cooling fan.

As illustrated in FIG. 1, a cooling fan of the prior art is essentially comprised of a fan blade unit (a) integrated with a stator coil unit (b), a circuit board (c) and a frame (d). Wherein, a spindle (a1) from the center of the fan blade unit (a) passes through a bearing (b1) at the center of the stator coil (b) to constitute a cooling fan as illustrated in FIG. 2. When the cooling fan rotates, the spindle (a1) engages in motion relatively to that of the bearing (b1). However, under long-term dynamic operation, the cooling fan is vulnerable to permit ingression the airflow carrying dust to fall on the gap between the spindle (a1) and the bearing (b1) to damage lubricity of the spindle (1a), then the spindle (1a) becomes slower, creates higher level of noise, and in serious case, and rendered inoperative due to jammed axis of the blade.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

SUMMARY OF THE INVENTION primary purpose of the present invention is to provide a cooling fan dust structure that prevents easy ingression of airflow carrying dust, and even keeps off the flying dust from falling on the spindle when the unit of fan blade is rotating. To achieve the purpose, a rib and a recess are provided on the inner side of the fan blade to create an overcut height difference with the opening of a bushing.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
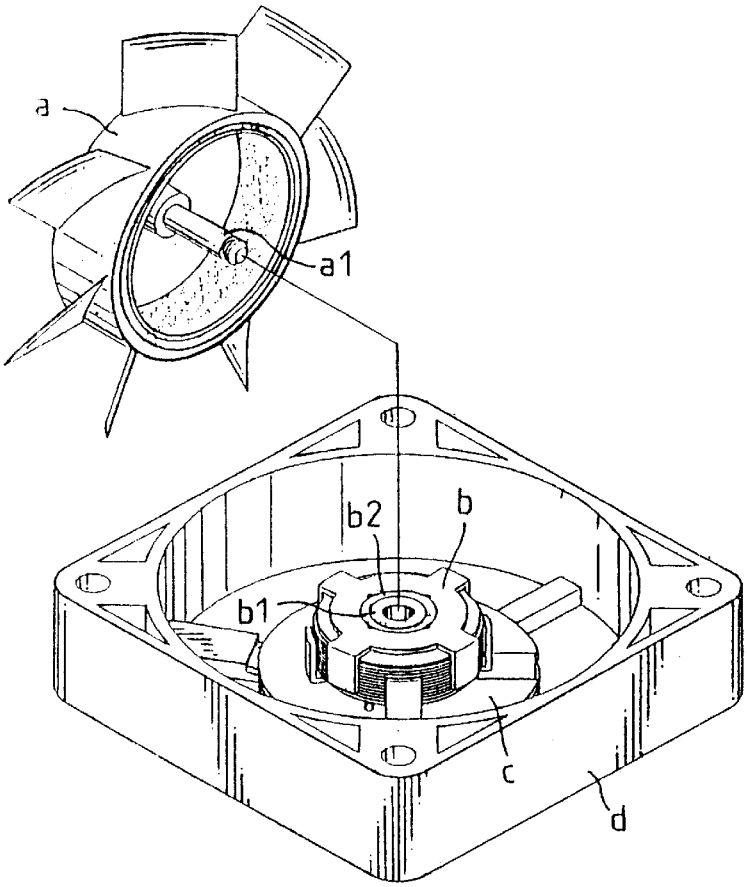
PRIOR ART FIG. 1
FIG. 1 is a view of a structure of a cooling fan of the prior art.
Figure 2:
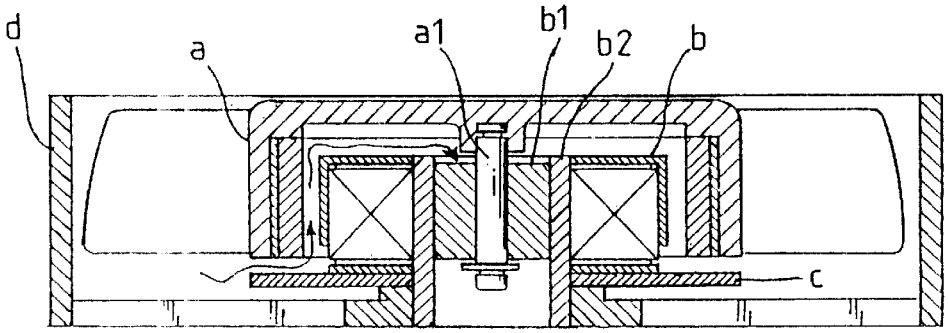
PRIOR ART FIG. 2
FIG. 2 is a sectional view of the cooling fan of the prior art.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, alterations and further modifications in the illustrated device, and further applications of the principles of the invention as illustrated herein being contemplated as would normally occur to one skilled in the art to which the invention relates.

Figure 3:
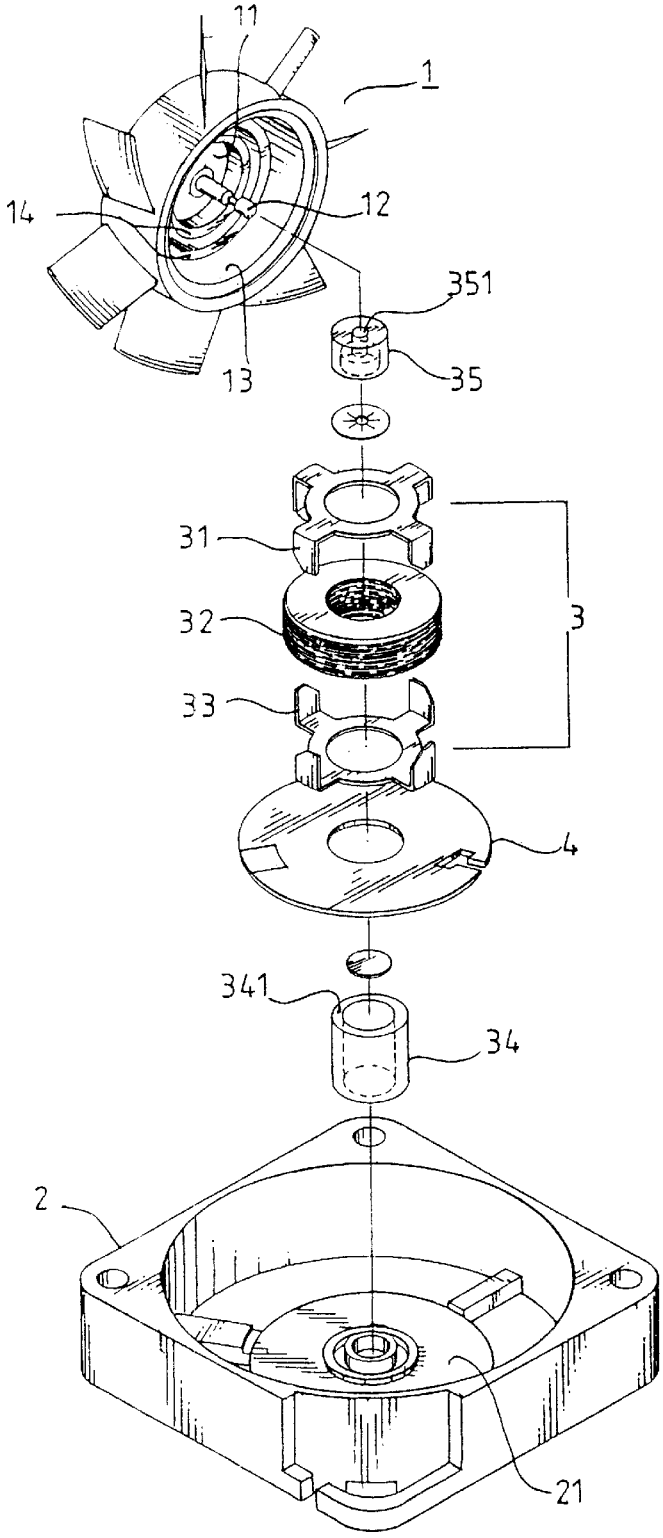
FIG. 3 is an exploded view of a structure of a cooling fan of a preferred embodiment of the present invention.

Referring to FIG. 3 for a cooling fan dust structure of the present invention, it is essentially comprised of a fan blade unit (1), a frame (2) having a motor base (21) at its center, a stator coil unit (3) fixed in the motor base, a bushing (34) in the stator coil unit (3), a bearing (35) in the bushing (34), and a through hole (351) formed on the end surface of the bearing (35) to allow penetration by a spindle (12) of the fan blade unit (1), within:

Said fan blade unit (1) generates airflow when driven and has a spindle (12) extending from the center of its inner surface (11). Between the spindle (12) and a magnet (13), two or more than two ribs (14) are concentrically provided with the inner surface (11) of the fan blade unit (1) as the geometric center. Those ribs (14) protrude from the inner surface (11) of the fan blade unit (1) at a height when assembled approximately close to the horizontal defined by multiples of upper magnetic bit (31) of the stator coil unit (3) so to form a winding slit (as illustrated in FIG. 4) by those ribs (14) and upper magnetic bits (31).

Figure 4:
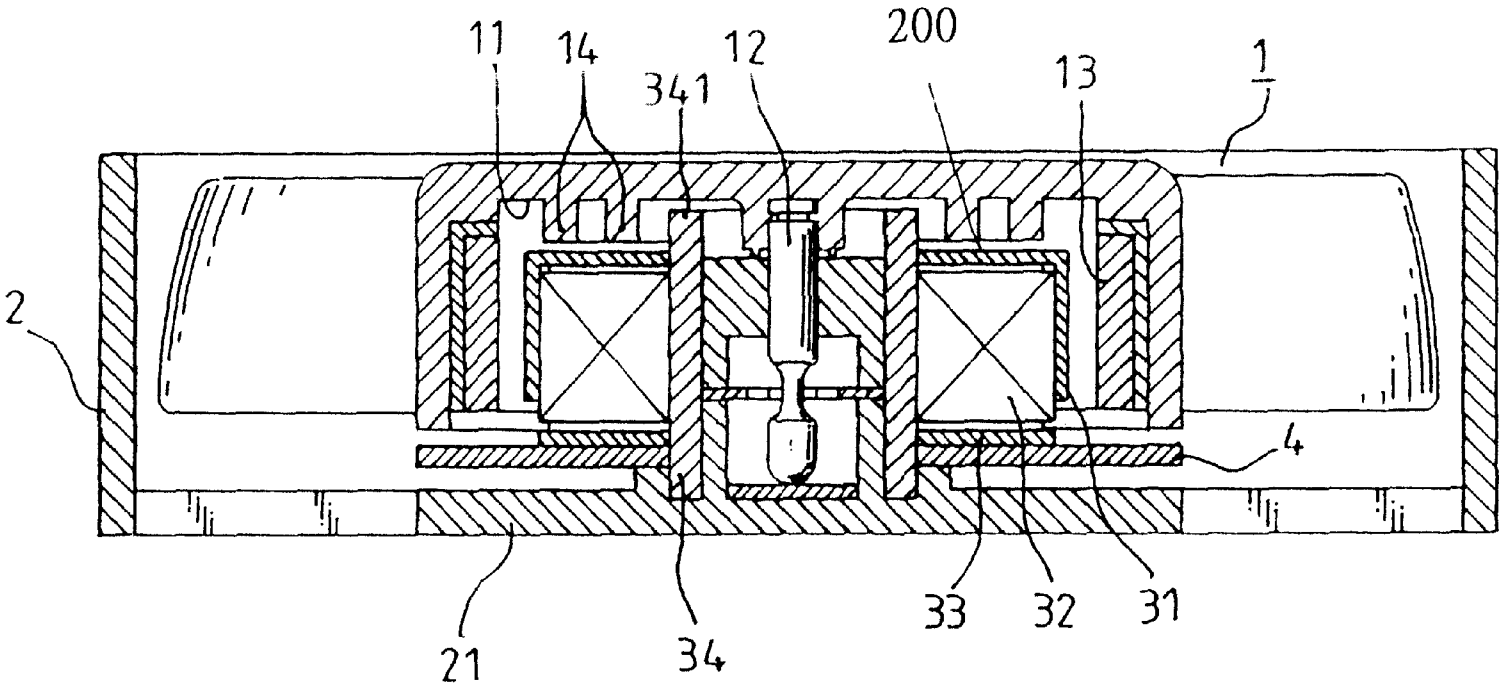
FIG. 4 is a sectional view of the preferred embodiment of the present invention.

Furthermore, an opening (341) of the bushing (34) at the center of the stator coil unit (3) above the horizontal defined by those upper magnetic bits (31) extends toward the inner surface (11) of the fan blade unit (1) at a height when assembled approximately close to the inner surface (11) of the fan blade unit (1) for both of the opening (341) of the bushing (34) and the inner surface (11) of the fan blade unit (1) to form another winding slit (200) (as illustrated in FIG. 4).

When assembled, an overcut height different formed by those ribs (14) provided on the inner surface (11) of the fan blade unit (1) and the protruded opening (341) of the bushing (34) increases the length of the route for airflow to prevent an easy ingression by the airflow carrying dust. Meanwhile, as the fan blade unit (1) rotates, the winding slit (200) created by those ribs (14) and upper magnetic bits (31) even stops the ingression of flying dust into the spindle (1).

Figure 5:
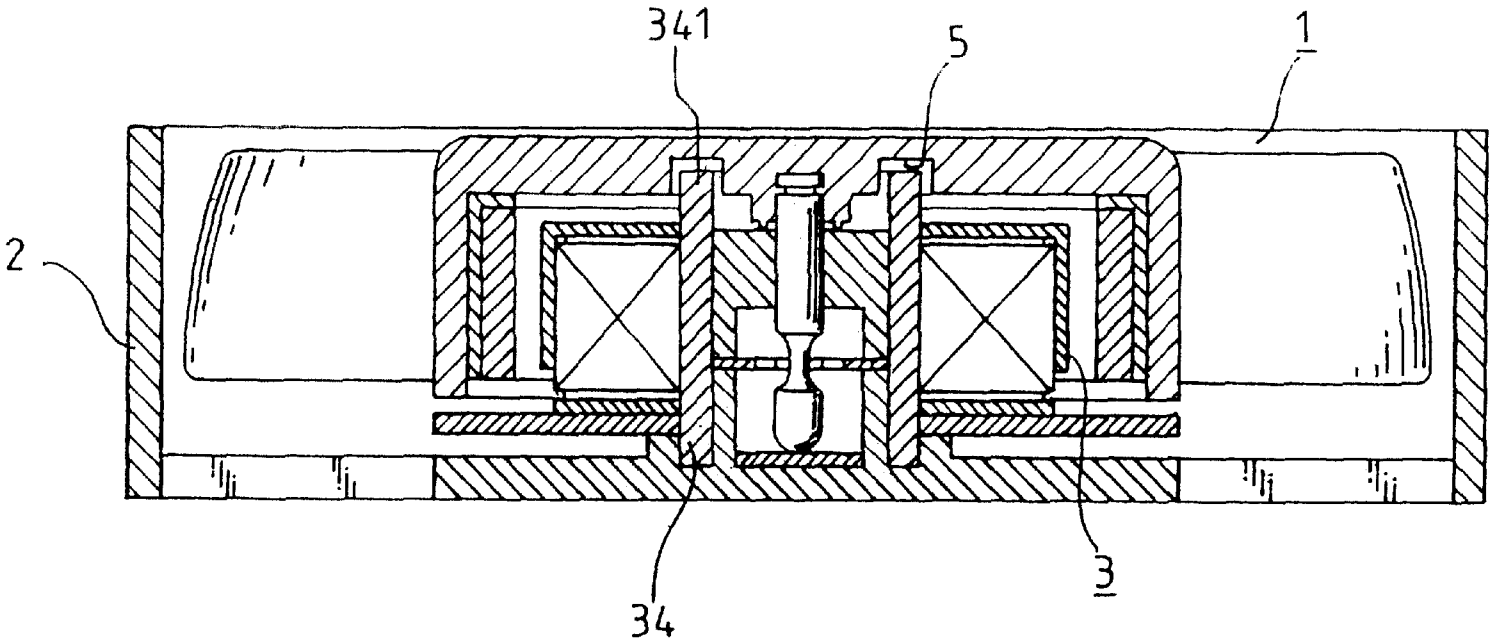
FIG. 5 is a sectional view of another preferred embodiment of the present invention.

Now referring to FIG. 5 showing a sectional view of a second preferred embodiment of the present invention, wherein, a recess (5) is provided on the inner surface (11) of the fan blade unit (1) at where in relation to the opening (341) of the bushing (34), and the opening (341) of the bushing (34) extends into the recess (5) to once again form an overcut height difference to prevent easy ingression of dust into the spindle (1).

The present invention for providing those ribs and recess outside the spindle to mutually form the overcut height difference to effectively stop ingression of flying dust to fall on the spindle to damage its lubricity; easy production from clearly defined and compact members, complies with industrial requirements. Therefore, this application is duly filed accordingly.

I claim:

1. A cooling fan dust structure comprising:

a frame having a motor base located in the center;

a stator coil unit having a bottom end fixed to said motor base;

a magnetic bit located on a top end of said stator coil unit;

a fan blade unit provide with two or more concentrically spaced ribs protruding from a bottom side of said fan blade unit closest to said stator unit, such that a winding slit is formed between said ribs and said magnetic bit; and a spindle supporting said fan blade unit;

a hollow bushing surrounded by said stator coil unit and extending above a top extent of said magnetic bit, such that a second winding slit is formed between the bottom side of the fan blade unit and said bushing;

wherein an overcut height difference is established between the ribs and the bushing increasing the distance air has to flow to reach the spindle preventing ingression of dust.

2. A cooling fan dust structure according to claim 1, further comprising a bearing located in said bushing and a through hole in said bearing to permit penetration by said spindle.

3. A cooling fan dust structure comprising:

a frame having a motor base located in the center;

a stator coil unit having a bottom end fixed to said motor base;

a fan blade unit provide with a recessed channel formed in a bottom side of said fan blade unit closest to said stator unit; and a spindle supporting said fan blade unit, a hollow bushing surrounded by said stator coil unit and extending above a top extent of said stator coil unit and penetrating into said recessed channel, such that a winding slit is formed between a bottom of said recessed channel and said bushing;

wherein an overcut height difference is established between said recessed channel and said bushing thereby increasing the distance air has to flow to reach the preventing ingression of dust.

4. A cooling fan dust structure according to claim 2, further comprising a bearing located in said bushing and a through hole in said bearing to permit penetration by said spindle.

* * * * *